US006050123A

United States Patent [19]

Fies

[11] Patent Number: 6,050,123

[45] Date of Patent: Apr. 18, 2000

[54] DEVICE FOR FORMING A SPOUT IN A CONTAINER

[76] Inventor: Robert Fies, Nordbeckenstr. 8, D-76189 Karlsruhe, Germany

[21] Appl. No.: 09/196,688

[22] Filed: Nov. 20, 1998

[30] Foreign Application Priority Data

Nov. 26, 1997 [DE] Germany ..... 197 52 373

[51] Int. Cl.[7] ..... B21D 28/10

[52] U.S. Cl. ..... 72/326; 72/379.4; 72/409.01; 72/409.16; 413/22; 413/53

[58] Field of Search ..... 72/326, 325, 379.4, 72/409.01, 409.16, 387; 413/22, 53

[56] References Cited

U.S. PATENT DOCUMENTS

| | | | |
|---|---|---|---|
| 3,058,213 | 10/1962 | Sandsto | 72/326 |
| 4,177,664 | 12/1979 | Spors | 72/326 |

FOREIGN PATENT DOCUMENTS

| | | | |
|---|---|---|---|
| 288 059 | 3/1991 | German Dem. Rep. . | |
| 24 55 840 | 6/1975 | Germany . | |
| 42 42 544 | 7/1994 | Germany . | |
| 297 05 219 | 5/1997 | Germany . | |
| 716082 | 9/1954 | United Kingdom | 72/325 |

*Primary Examiner*—Daniel C. Crane
*Attorney, Agent, or Firm*—Paul Vincent

[57] ABSTRACT

A device for forming a spout in a container (8) such as a can or the like, comprises a pressure element (11) for introduction into the container (8) and a cutting element (10) for engagement at an outer side (26) of the container (8) which move towards each other in the manner of a pliers to capture the container (8).

16 Claims, 4 Drawing Sheets

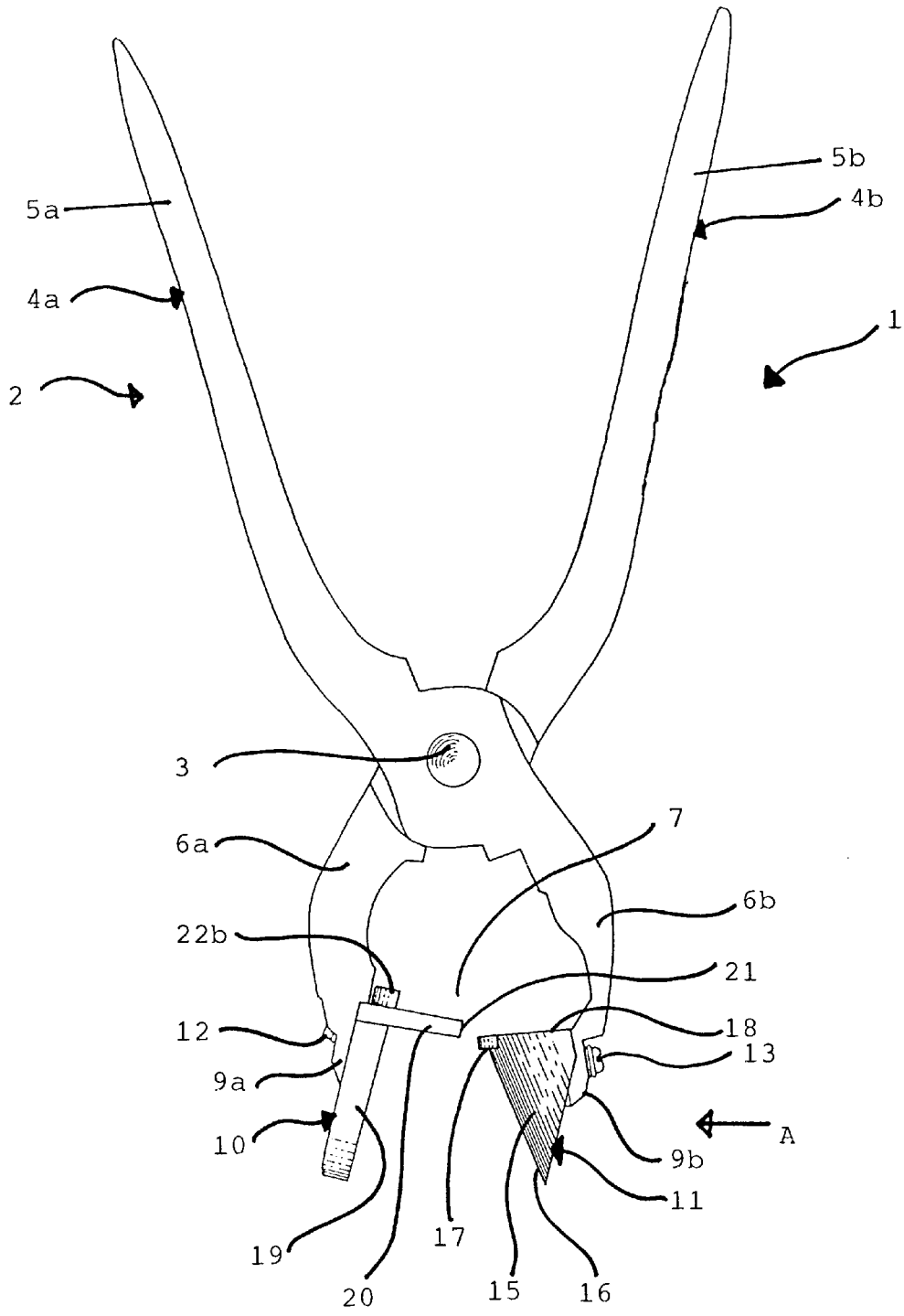
Figur 1

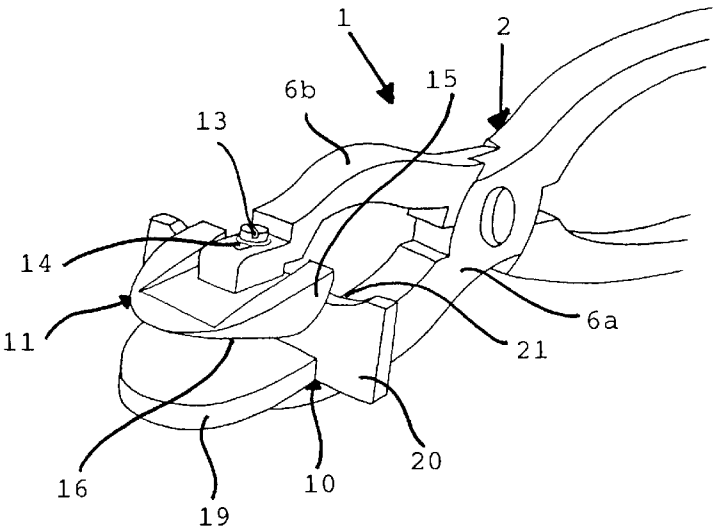
Figur 3
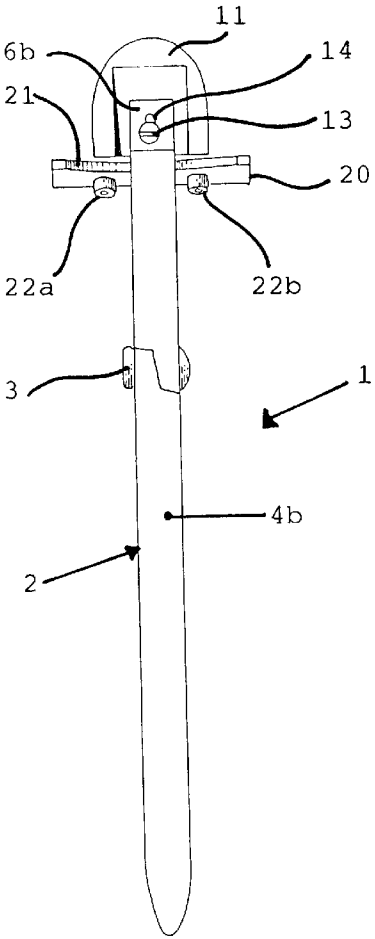
Figur 2

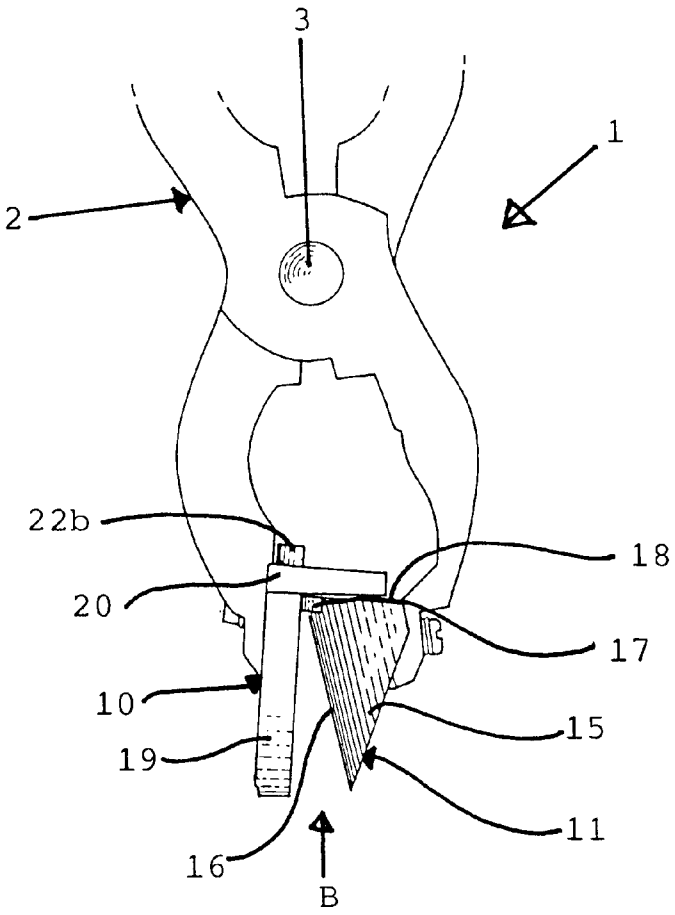
Figur 4
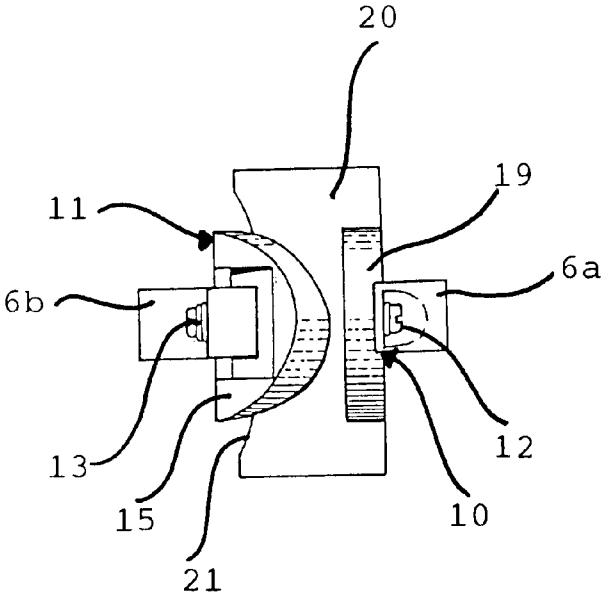
Figur 5

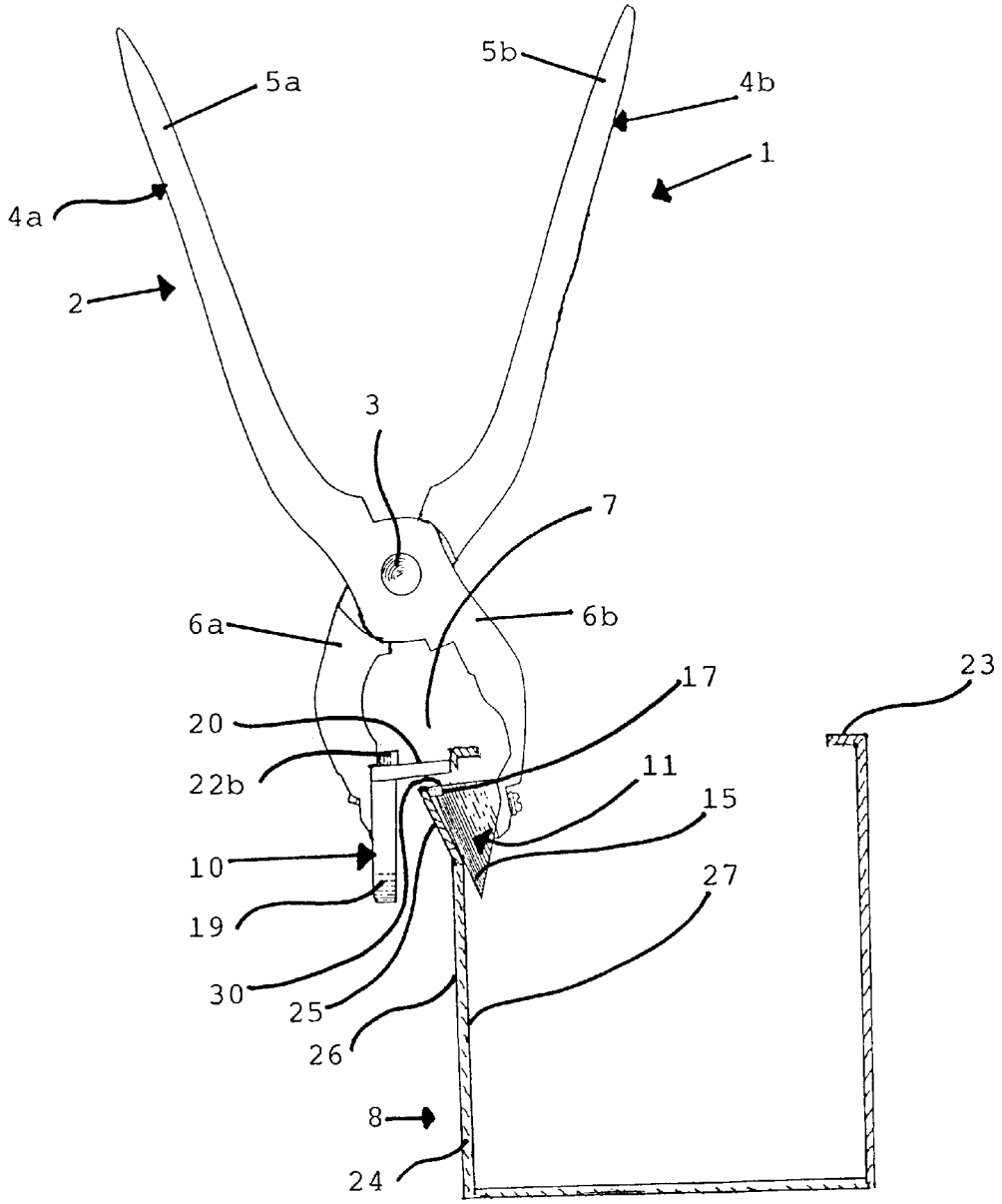
Figur 6

DEVICE FOR FORMING A SPOUT IN A CONTAINER

This application claims Paris Convention Priority of German Patent application number 197 52 373.0 filed Nov. 26, 1997 the complete disclosure of which is hereby incorporated by reference.

BACKGROUND OF THE INVENTION

The invention concerns a device for forming a spout in a container such as a can or the like.

Painting installations, in particular for painting vehicles, use paint to which a curing agent must be added when mixing the paint. For this reason, residual amounts of paint remaining in the container do not harden with time, but remain in a viscous state. So-called scrapers, e.g. known in the art from DE-GM 9406714, can be used to remove these residual amounts of paint from the inner walls of the container. This method of removal is however extremely difficult. For this reason, a hole has been introduced into the floor of the container through which the residual amount of paint can flow in a downward direction. A careful pouring out of the residual amount of paint is however not possible using such an opening in the floor.

It is therefore the purpose of the invention to create a device of the above mentioned kind by means of which a spout can be created to facilitate a precise pouring out of residual amounts of paint.

SUMMARY OF THE INVENTION

This purpose is achieved in accordance with the invention by means of a device of the above mentioned kind, characterized by a pressure element for introduction into the container and a cutting element engaging the outer side of the container which can be moved towards each other in a tong-like fashion to capture the container. The configuration in accordance with the invention facilitates formation of a spout in the upper region of the paint container by means of which the residue in the container can be carefully poured out. In this manner, use of an appropriate scraper guarantees proper cleaning of the container so that this container no longer contains chemical wastes and can be recycled. The configuration in accordance with the invention also facilitates easy formation of the spout in the upper region of the container. This configuration also takes into account the fact that the majority of the residual paint in the container is located in the vicinity of the upper inner peripheral edge. A scraper can then be used to introduce this residue to the spout which is also located in this region.

On order to keep the amount of force required for forming the spout within acceptable limits, the pressure and cutting elements are each preferentially disposed on the end of a tong-like handle. In this manner, the associated leverage allows a relatively small force to easily produce the opening in the container wall.

In order to be able to exchange the pressure as well as the cutting elements in the event of wear or for differing containers, the pressure as well as the cutting elements are fixed to the handle portion in a detachable manner.

An improvement provides that the relative heights of the pressure as well as the cutting elements are adjustable. This configuration facilitates differing spout shapes and allows for the adaptation of the pressure and the cutting elements to differing paint container shapes. The detachable fixing of the pressure and the cutting element to the handle portion is preferentially effected using screws. The height adjustment is thereby effected by means of slotted holes disposed in the end of the handle portion along its longitudinal extent, which are penetrated through by the screws. The screws can then be displaced in a defined fashion within these slotted holes.

In order to give the spout a shape similar to that of a nozzle or snout, such as in a watering can, the pressure element preferentially has a curved cross-sectional shape. The convex surface formed by the curve of the pressure element preferentially faces the inner wall of the container to transfer the curvature to the inner wall of the container during operation of the device while simultaneously bending out same. This is possible since height adjustment allows the cutting element to engage above the pressure element at the outside of the container wall. In order to simplify bending out of the inner wall of the container, the pressure element preferentially has a nose disposed at its upper end region and projecting towards the cutting element. This nose, preferentially fashioned out of the pressure element, then initially engages at points of the inner container wall during the bending out process and, together with the outer engaging cutting element, cuts into the wall of the container to bend out an associated portion of this wall. An improvement provides that this pressure element tapers substantially towards its lower end region to create a nozzle-shaped spout widening from below towards the upper direction for optimal pouring out of the residual paint.

In a preferred embodiment, the cutting element is made from two mutually substantially perpendicular legs of which that leg facing the outer wall of the container has a cutting edge on its free end. This preferred embodiment effects a cutting out of the container wall, in cooperation with the inwardly engaged pressure element, by that leg extending towards the outer wall of the container, wherein the pressure element can move in an optimum manner below this leg, with the second leg providing stabilization of the cutting element and also serving as a stop for the container wall outwardly bent towards this leg.

The cutting edge is preferentially substantially concave for optimal engagement at the outer wall of a container having a rounded cross-section. If the container which is to be cleaned is a rectangular paint container, as are often used for storage of paints in vehicle painting facilities, the cutting edge can clearly also be substantially flat for optimal engagement at the outer side of the container wall. Should, however, the cutting edge be essentially concave, the radius of curvature of the cutting edge substantially corresponds to the curvature of the container. In this manner, the container can be optimally fixed at the outside and the inside for fashioning the spout.

In order to be able to exchange the cutting edge for differing containers as well as in the event of wear, a further improvement provides that the legs are fixed to each other in a detachable fashion.

In accordance with the invention, a device is thereby created for fashioning, in a simple and reliable fashion, a spout in the form of nozzle in a container such as a can preferentially in the upper region of the container for both round and rectangular containers to facilitate pouring out of the residual paint still located within the container. If a scraper is used, as is known in the art e.g. from DE-GM 94 06 714, on the order of 30 grams of residual paint can be removed from a 1-liter can and up to 70 or 80 grams of residual paint from a 5-liter rectangular can in a simple and reliable fashion. These cans can therefore be recycled following cleaning and do not contain chemical waste material.

Further advantages and features of the invention can be extracted from the claims and from the following description in which an embodiment is described in greater detail with reference to the drawing.

BRIEF DESCRIPTION OF THE DRAWING

FIG. 1 shows a front view of a device in accordance with the invention in an opened state;

FIG. 2 shows a side view of the device of FIG. 1 corresponding to arrow A of FIG. 1;

FIG. 3 shows a perspective view of the device of FIG. 1;

FIG. 4 shows a partial view of the device of FIG. 1 in a closed state;

FIG. 5 shows a plan view of the device corresponding to arrow B of FIG. 4, and FIG. 6 shows a longitudinal cut through a can having an introduced device for explanation of the functioning thereof.

DESCRIPTION OF THE PREFERRED EMBODIMENT

A device 1 in accordance with the invention shown in FIG. 1 is subsequently referred to as a cutting device, although it could be designated as a "snounter" tongs in view of its use for creating a "snout". The device has a tong-like handle portion 2 consisting essentially of two crossed legs 4*a,* 4*b* linked to each other by a rivet 3, the longer back portions 5*a,* 5*b* of which serve as handles and with the shorter front portions 6*a,* 6*b* serving as jaws of a tong mouth 7 for engagement and fixing of worked objects, in this case, a paint container (see FIG. 6).

A cutting element 10 and a pressure element 11 are disposed at facing sides of the free ends 9*a,* 9*b* of the jaws 6*a,* 6*b*.

Both the cutting element 10 as well as the pressure element 11 are fixed by screws 12, 13 to the jaws 6*a,* 6*b* in a detachable fashion. These screws thereby penetrate through slotted holes 14 formed along a longitudinal extension direction in the respective jaw, as can be seen in FIGS. 2 and 3 for the screw 13 fixing the pressure element 11. Such slotted holes 14 permit the heights of both the pressure element 11 as well as the cutting element 10 to be adjusted relative to each other or simultaneously.

The pressure element 11 has a pressure member 15 having a curved cross-sectional shape, wherein the convex surface 16 formed by the curvature of the pressure member 15 faces the cutting element 10 and the pressure member 15 is tapered in a direction towards its lower free end region so that the pressure element 11 has a side view shape of a cone tapered downwardly to a tip, wherein the pressure element 11, as viewed from the rear, has a substantially curved shape. The pressure member has a nose 17 at its upper end region protruding towards the cutting element 10 and fashioned out of the pressure member 15. The upper side 18 of the pressure member 15 is substantially flat.

The cutting element 10 is formed by two mutually perpendicular legs 19, 20, wherein the leg 20 facing the jaw 6*b* and the pressure element 11 is screwed at one end to the upper side of the leg 19 and has a cutting edge 21 at its free end.

As shown in FIG. 2, screwing is thereby effected from the side of the legs 4*a,* 4*b* using two detachable screws 22*a,* 22*b*.

The cutting edge 21 can be flat but, in the embodiment shown, is curved in a concave fashion and has a radius of curvature substantially corresponding to the curvature of the container 8 in which the spout is to be fashioned.

FIG. 6 shows the cutting device in accordance with the invention 1 in operation. The container to be opened is a can 8 having a rounded cross-section with a peripheral edge 23 extending about its upper inner side. In order to form a spout, the pressure element 11 is introduced into the container 8 with the tong mouth 7 opened until that region of the wall of the container 24 is reached at which the spout is to be formed. In the embodiment shown, this region 25 is directly below the inner peripheral edge 23. The jaws 6*a,* 6*b* are then moved towards each other through operation of the handles 5*a,* 5*b,* wherein the cutting element 10 engages the outer wall 26 of the container 8 below the edge 23 with its cutting edge 21 and the nose 17 of the pressure element 11 engages the inner wall 27 of the container 8. The forces which thereby result cause the wall of the container 24 to be cut above the region 25 and, by means of the pressure element 11, the container region 25 is pushed in an outward direction and angled off in correspondence to the curvature of the pressure body 15. The tong mouth 17 is then reopened and the cutting device 1 is removed from the container 8. The paint remaining in the container 8 can then be poured out via the fashioned spout.

I claim:

1. A device for forming a spout in a container wall, comprising:

a cutting element for engaging an outside of the container wall;

a pressure element for introduction into the container, said pressure element having a curved cross sectional shape; and a tong member for moving together said cutting element and said pressure element to capture the container wall, wherein said tong member is pressed together to move said pressure element into engagement with an inside of the container wall and to move said cutting element into engagement with the outside of the container wall and continued pressing of said tong member urges said pressure element to bend and press out the spout by deforming the container wall and urges said cutting element to cut through the container wall at an upper region of the spout.

2. The device of claim 1, wherein said tong member comprises a first handle having an end on which said pressure element is disposed and a second handle having an end on which said cutting element is disposed.

3. The device of claim 2, wherein said pressure element is mounted for detachment to said first handle and said cutting element is mounted for detachment to said second handle.

4. The device of claim 1, further comprising means for adjusting a height of said cutting element relative to a height of said pressure element.

5. The device of claim 2, further comprising means for adjusting a height of said cutting element relative to a height of said pressure element.

6. The device of claim 3, further comprising a first screw member for fixing said pressure element to said first handle and a second screw member for fixing said cutting element to said second handle.

7. The device of claim 4, further comprising a first screw member for fixing said pressure element to said first handle and a second screw member for fixing said cutting element to said second handle.

8. The device of claim 5, further comprising a first screw member for fixing said pressure element to said first handle and a second screw member for fixing said cutting element to said second handle.

9. The device of claim 8, wherein said adjustment means have a first slotted hole formed in said first handle along a first longitudinal extent thereof for accepting said first screw member and a second slotted hole formed in said second handle along a second longitudinal length thereof for accepting said second screw member.

10. The device of claim 1, wherein said curved cross-sectional shape defines a convex surface in said pressure element facing an inner wall of the container.

11. The device of claim 10, wherein said pressure element comprises a nose at an upper end thereof protruding towards said cutting element.

12. The device of claim 11, wherein said pressure element substantially tapers in a direction towards a lower end thereof.

13. The device of claim 1, wherein said cutting element comprises a first leg facing an outer wall of the container and having a cutting edge on a free end thereof and a second leg, substantially perpendicular to said first leg.

14. The device to claim 13, wherein said cutting edge is substantially concave.

15. The device of claim 13, wherein said cutting edge has a radius of curvature substantially corresponding to a radius of curvature of the container.

16. The device of claim 13, further comprising means for attaching said first leg to said second leg in a detachable fashion.

* * * * *